US006960156B2

(12) United States Patent
Smith

(10) Patent No.: US 6,960,156 B2
(45) Date of Patent: Nov. 1, 2005

(54) DEVICE FOR DIRECTING AIR FLOW AT USERS OF AIR RESISTED EXERCISE MACHINES

(76) Inventor: Paul Smith, 23 157th Ave. SE., Bellevue, WA (US) 98008

( * ) Notice: Subject to any disclaimer, the term of this patent is extended or adjusted under 35 U.S.C. 154(b) by 475 days.

(21) Appl. No.: 10/147,721

(22) Filed: May 16, 2002

(65) Prior Publication Data

US 2003/0216227 A1 Nov. 20, 2003

(51) Int. Cl.[7] ..... A63B 69/06
(52) U.S. Cl. ..... 482/72; 482/51
(58) Field of Search ..... 482/72, 51, 57–65

(56) References Cited

U.S. PATENT DOCUMENTS

| | | | | |
|---|---|---|---|---|
| 3,970,302 | A | 7/1976 | McFee | |
| 4,396,188 | A | 8/1983 | Dreissigacker et al. | |
| 4,555,911 | A | 12/1985 | Kusisto | |
| 4,589,656 | A | 5/1986 | Baldwin | |
| 4,844,450 | A | 7/1989 | Rodgers, Jr. | |
| 4,932,650 | A | 6/1990 | Bingham et al. | |
| 4,971,316 | A | 11/1990 | Dalebout et al. | |
| 5,000,444 | A * | 3/1991 | Dalebout et al. | 482/59 |
| 5,190,021 | A * | 3/1993 | Hull et al. | 124/20.1 |
| 5,251,435 | A * | 10/1993 | Pauley | 60/226.1 |
| RE34,478 | E * | 12/1993 | Dalebout et al. | 482/59 |
| 5,269,736 | A | 12/1993 | Roberts | |
| 5,290,212 | A * | 3/1994 | Metcalf | 482/62 |
| 5,356,356 | A | 10/1994 | Hildebrandt et al. | |
| 5,707,322 | A * | 1/1998 | Dreissigacker et al. | 482/72 |
| 5,836,839 | A * | 11/1998 | Kay | 473/511 |
| 5,911,649 | A | 6/1999 | Miller | |
| 6,027,429 | A | 2/2000 | Daniels | |
| 6,155,280 | A * | 12/2000 | Powell et al. | 135/124 |
| 6,194,798 | B1 * | 2/2001 | Lopatinsky | 310/63 |
| 6,220,991 | B1 * | 4/2001 | Sellers | 482/62 |
| 6,378,585 | B1 | 4/2002 | Saeki | |

* cited by examiner

*Primary Examiner*—Gregory L. Huson
*Assistant Examiner*—Fenn C. Mathew
(74) *Attorney, Agent, or Firm*—Garrison & Associates PS; David L. Garrison

(57) ABSTRACT

The current invention disclosed a device for directing a concentrated airflow at the user of an air resisted exercise machine. The cowling disclosed in this invention is constructed from either a semi-rigid material or low-porosity fabric and can be removably attached to the cage covering the fan type blades usually associated with such machines. Various means can be used to attach the device to the cage, one means being the use of elastic cords routed through welts. In use, the device of the current invention directs air at the user of the machine. The device is lightweight and portable, and a user can carry the device along for use on machines in a variety of places.

14 Claims, 4 Drawing Sheets

DEVICE FOR DIRECTING AIR FLOW AT USERS OF AIR RESISTED EXERCISE MACHINES

FIELD OF INVENTION

This invention relates to air-resisted exercise machines. In particular, this invention describes a cowling for directing a concentrated airflow at the user of an air-resisted rowing machine thereby cooling the user during exercise.

BACKGROUND OF THE INVENTION

As the public becomes more aware of the benefits of physical fitness, the demand for equipment adapted for performing physical fitness exercises is growing. Presently, there exists a great variety of equipment that is usable indoors to simulate exercising activities that traditionally are considered outdoor activities. This equipment permits the user to exercise year round, independent of outdoor weather conditions. Furthermore, many types of such equipment are now being manufactured for use in the operator's home. While such equipment does simulate outside exercise activities, the user of such equipment remains stationary relative to his or her surroundings and does not get the benefit of a cooling breeze that is created by movement. Several exercise machines have been designed with devices to direct an air flow at a user. U.S. Pat. No. 5,356,356, issued to Hildebrandt et al., discloses a stationary exerciser that includes a blower assembly operated by rotation of a flywheel to blow air through a duct inside of the device and onto the user. U.S. Pat. No. 4,932,650, issued to Bingham et al., discloses an Exercycle with air vents in the housing for directing air at the user. While these devices do direct air at the user, not all gyms are equipped with such exercise machines. Additionally, such machines are typically heavy and bulky thereby making them less appealing for use in the home.

Air resisted exercise machines are lighter in weight and require less storage space than most non air-resisted machines that simulate the same exercise. U.S. Pat. No. 4,971,316, issued to Dalebout et al., discloses an exercise cycle with fan type blades housed inside a cage. These blades provide a resistance force that simulates the force required to operate a bicycle and they direct air upward at the user from behind. Similarly, U.S. Pat. No. 4,396,316, issued to Dreissigacker et al., discloses a stationary rowing machine that uses fan blades for resistance. U.S. Pat. No. D367,508, issued to Dreissigacker et al., shows a stationary rowing machine that uses fan blades for resistance and those fan blades are enclosed in a cage.

While the fan type blades of these air-resisted exercise machines do provide a flow of air that could cool the user, this air is not directed at the user in a concentrated flow. Instead, the airflow generated by the fan type blades flows outward from the exterior perimeter of the fan or cage in all directions.

Thus there exists a need for a device that can be used to direct a concentrated flow of air at the user of an air resisted exercise machine having a plurality of fan type blades that are enclosed in a cage. Such a device should be removably attachable to these machines so that an exerciser can use it on machines in different locations (i.e., rowing machine at home, rowing machine at a gym, rowing machine at a competition, etc.). Such a device should also be attachable to machines that are currently available.

SUMMARY OF THE INVENTION

Accordingly, it is an object of this invention to provide a device for directing a concentrated airflow at the user of an air resisted exercise machine.

It is a further object of this invention to provide such a device that is lightweight, portable, and easy to store.

It is yet another object of this invention to provide such a device that can be used on exercise machines that are currently available for purchase.

A further object of this invention is to provide such a device that a user can removably attach to an exercise machine so that he or she can use it on different machines. Another object of this invention is to provide such a device at a relatively low price.

These and such other objects of the invention, as will become evident from the disclosure below, are met by the invention disclosed herein.

This invention provides a lightweight, flexible cowling constructed from low-porosity fabric. The cowling can be attached to and removed from an exercise machine so that a user can take it with him or her when exercising at different locations or on different machines. The cowling is especially suitable for use on stationary rowing machines of the type that are currently manufactured and sold by Concept 2, Inc. and shown in U.S. Pat. No. D367,508, issued to Dreissigacker et al.

One preferred embodiment of the current invention provides a semicircular cowling constructed from a material with enough flexibility to allow the cowling to be removably attached to the cage enclosing the fan type blades of an air resisted exercise machine. Examples of such material would be semi-rigid plastic and thin aluminum.

Another preferred embodiment of the current invention provides a semicircular cowling constructed from a low-porosity fabric such as rip stop nylon. The cowling has an arch shaped cross section with the legs of the arch being the walls of the cowling and the base of these legs being the edges of the cowling. In one preferred embodiment of the current invention, the semicircular shape of the cowling is such that it covers approximately 75% of the circumference of the cage around the fan type blades of the exercise machine.

Various means can be used to removably attach the cowling to the exercise machine. In one preferred embodiment, flexible cords are used for attachment. However, other means such as hook pile type fasteners can also be used.

To use the device of the current invention, an exerciser simply attaches the cowling to the cage and adjusts the cowling so that it will direct a flow of air at the point desired by the user. The user then begins to exercise in a normal manner and a concentrated flow of cooling air is directed at him or her.

BEST MODE OF CARRYING OUT THE INVENTION

Figure 1:
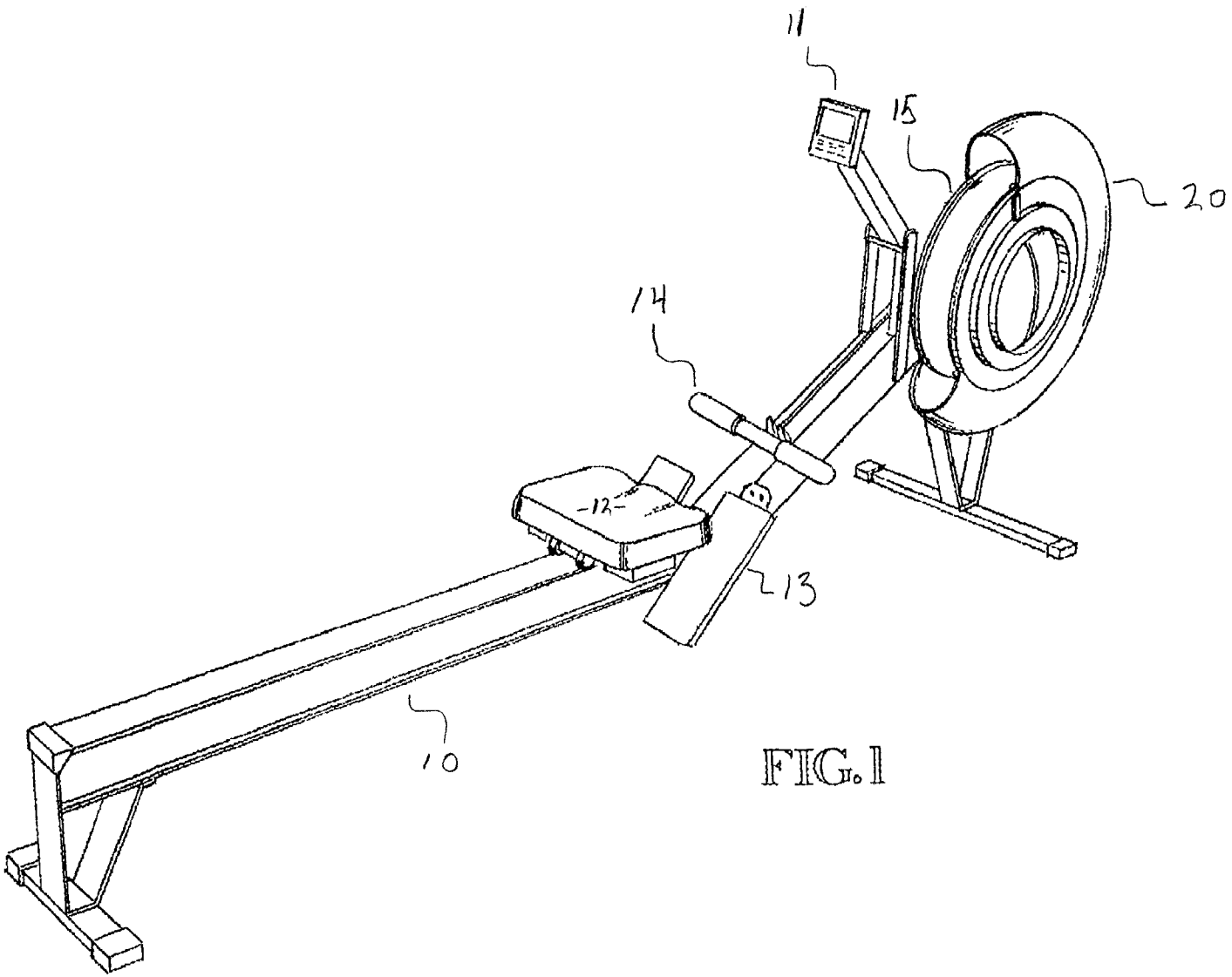
FIG. 1 is a perspective view showing the device of the current invention attached to a stationary rowing machine.

Turning now to the drawings, the invention will be described in preferred embodiments by reference to the numerals of the drawing figures wherein like numbers indicate like parts.

FIG. 1, shows the device 20 of the current invention attached to the cage 15 covering a plurality of fan type blades (not shown), which provide air resistance for a stationary rowing machine 10. The device of the current invention is a cowling 20 that can be constructed from a semi-rigid material or a flexible low-porosity fabric. Porosity is a fabric's ability to allow air to pass through and low-porosity fabrics allow less air to pass through than high porosity fabrics.

In one preferred embodiment, the cowling is constructed from rip stop nylon having a denier of 200. However, fabrics with a denier from the range of 100 to 250 are also suitable for constructing the cowling.

The rowing machine depicted in FIG. 1 is similar to machines that are currently manufactured and sold by Concept 2, Inc. and shown in U.S. Pat. No. D367,508, issued to Dreissigacker et al. To use the machine, a user sits on the seat 12 in a normal rowing position with his or her feet on foot rests 13. The user then pulls the handle 14 in the same manner as one would pull an oar, cables and gearing mechanisms operate to turn the fan type blades thereby providing air resistance that simulates rowing in water. The display module 11 provides a user with information showing how far the rower would have traveled was he or she actually rowing on water.

Regardless of the material used to construct it, the cowling 20 is shaped to conform to the cage 15 surrounding the fan type blades. In one preferred embodiment the cowling is semicircular in shape and covers approximately 75% of the exterior circumference of the cage 15.

Figure 2:
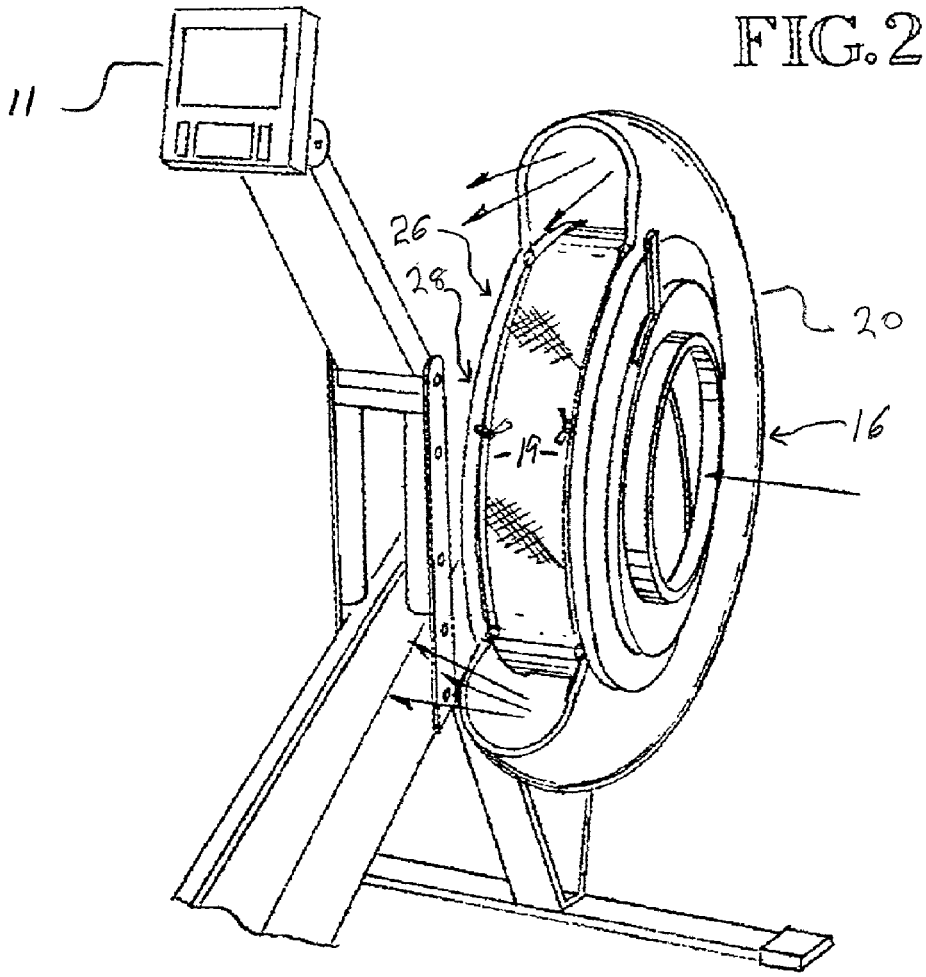
FIG. 2 is a perspective view showing the flow of air into the fan type blades of a stationary rowing machine and out through the device of the current invention.
Figure 3:
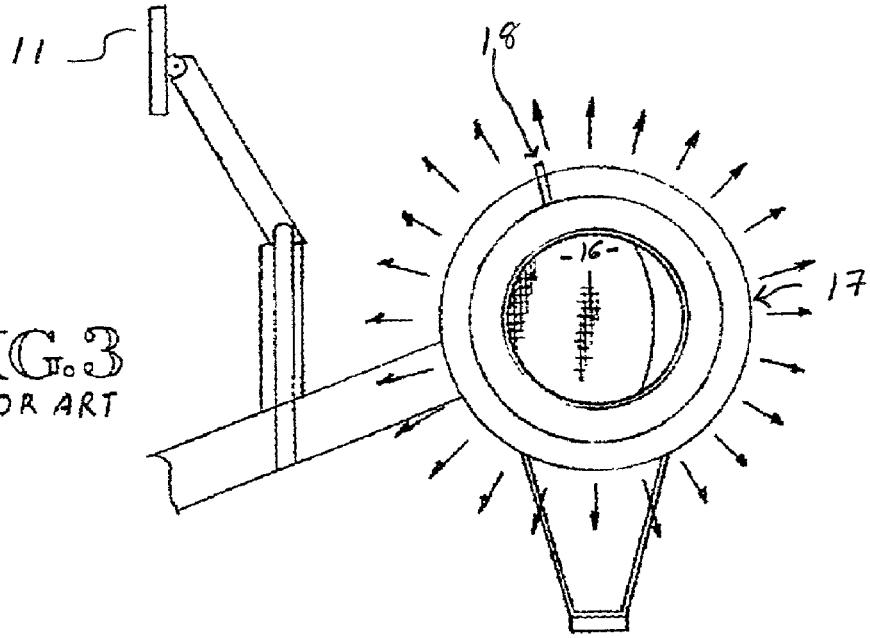
FIG. 3 PRIOR ART
FIG. 3 is a side view showing the flow of air out of the cage covering the fan type blades on a stationary rowing machine, when the device of the current invention is not used.

FIG. 3, shows the cage covering the fan type blades, without the current invention attached and FIG. 2 shows the cage with the current invention attached. Prior to using the machine, a user selects the desired level of resistance and adjusts the damper 17 with using the adjustment bar 18. For a lower level of resistance, the user would adjust damper 17 to cover a larger portion of the air intake screen 16 than would be covered for a higher level of resistance. When the machine is in use, air (as depicted by the arrows in the figures) flows into the cage through intake screen 16 and exits the cage through the outlet screen 19 on the exterior circumference of the cage.

When the cowling 20 of the current invention is not installed, air exits the cage and is dispersed uniformly about the cage. When the cowling of the current invention is installed, the airflow exiting the cage is concentrated and directed outward from the ends of the cowling.

Various means can be used to removably attach the current invention to the cage. In one preferred embodiment, elastic cords 26 are routed through welts created in the fabric. The cords 26 are sufficiently long so that they can be placed around the exterior of the cage and hold the cowling 20 snugly in place. In the embodiment depicted in FIG. 2, the ends of the cords 26 are connected together with a knot 28, but various fastening devices can also be used to connect the ends to each other.

Figure 4:
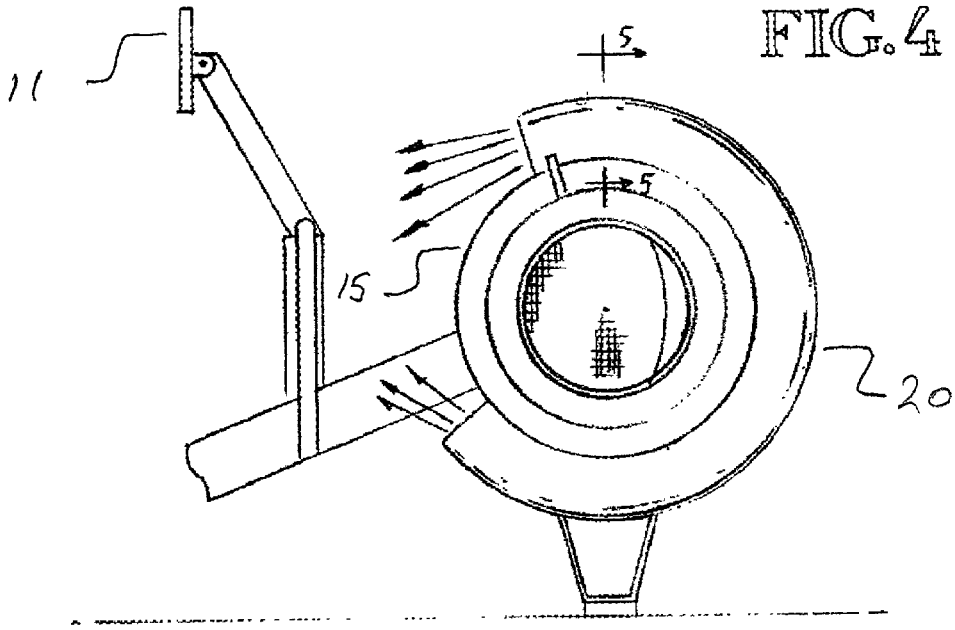
FIG. 4 is a side view showing the device of the current invention attached to the cage covering the fan type blades of a stationary rowing machine.

FIG. 4 shows the flow of air (as depicted by the arrows in the figure) from the cowling 20 of the present invention. A user of the exercise machine can adjust the cowling to further direct the air to a desired location by rotating the cowling 20 about the exterior circumference of the cage 15.

Figure 5:
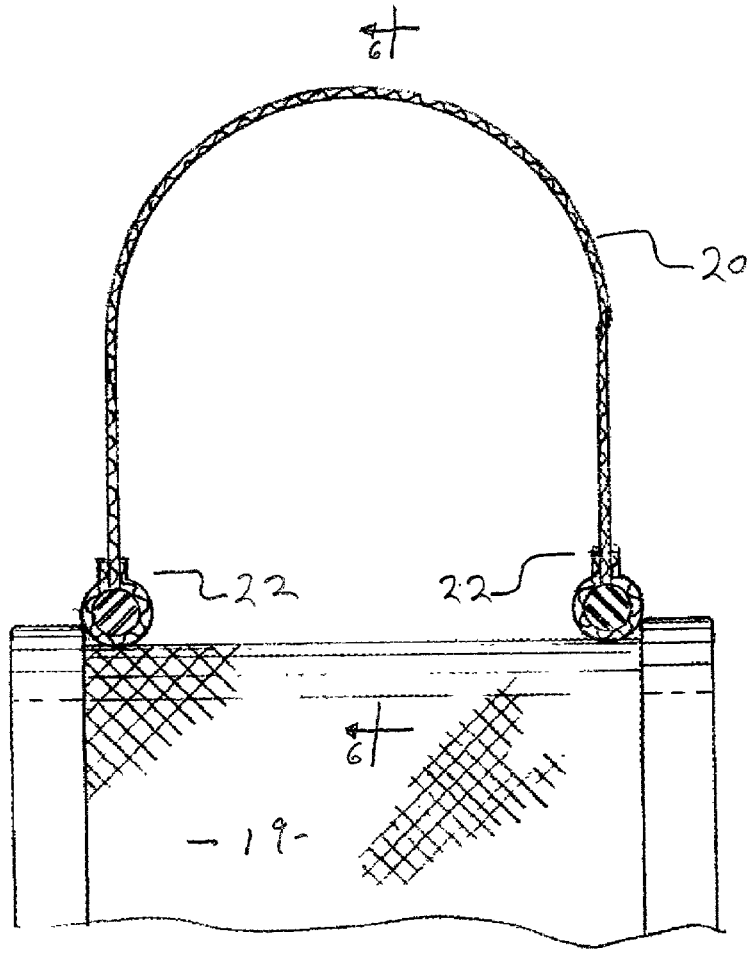
FIG. 5 is a cross-sectional view of the device of the current invention, taken along line 5—5 of FIG. 4.

FIG. 5 shows the arch shaped cross-section of the cowling 20. The legs of the arch form the walls of the cowling and the bases of the legs form the edges of the cowling. The distance from the outlet screen 19 to the apex of the arch can vary, and in one preferred embodiment, the distance from the outlet screen 19 to the apex of the arch is at least 5.75 inches. It has been found that shorter distances do not allow sufficient airflow and interfere with the computer display program of the type of rowing machine manufactured by Concept 2, Inc. However, machines manufactured by other makers, or machines other than stationary rowing machines may require a shorter or longer distance to work properly.

FIG. 5 further shows the welts 22 used in one preferred embodiment of the invention. The welts 22 are made by attaching the edges of a narrow strip of fabric to both sides of the walls of the cowling along the entire length of the cowling. The welts 22 are sufficiently large to allow elastic cords to be routed through them for use in attaching the cowling to the exercise machine. This method works equally well for cowlings constructed of semi-rigid material and cowlings constructed from fabric. In another preferred embodiment, which is constructed from fabric, the welts are formed by folding the edge of the cowling inward and attaching it to the wall of the cowling.

Figure 6:
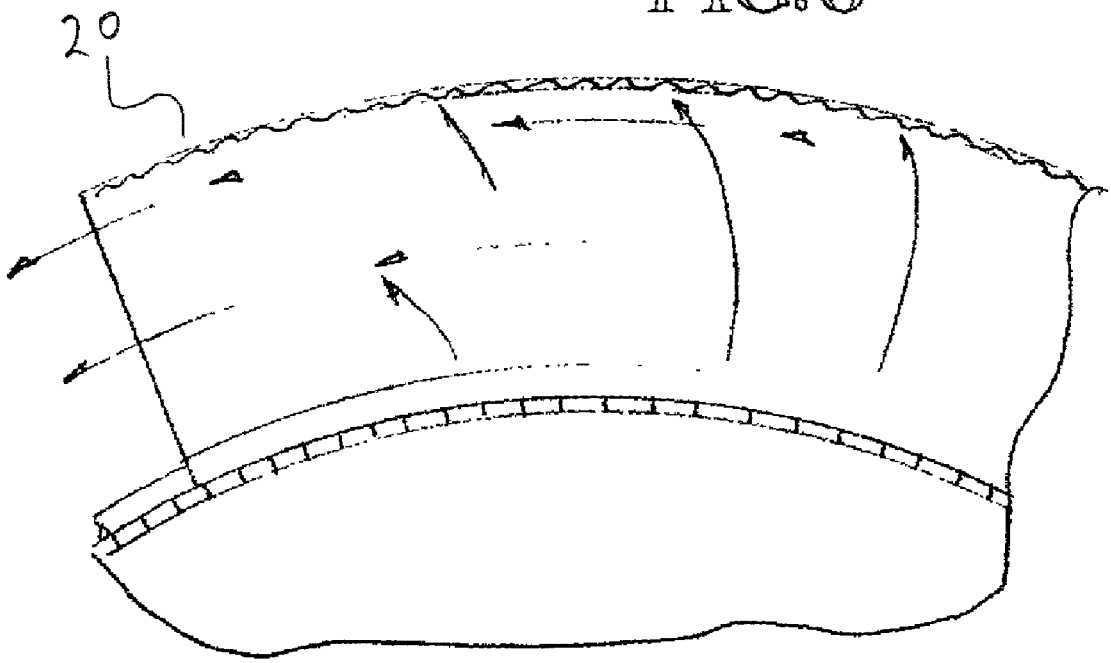
FIG. 6 is a sectional view taken along line 6—6 of FIG. 5.

FIG. 6 is a sectional view showing the direction of airflow (as depicted by the arrows in the figure) through the cowling of the current invention as it exits the outlet screen.

To use embodiments of the current invention that is constructed from fabric on the type of rowing machine currently manufactured and sold by Concept 2, Inc., a user stretches the elastic cords around the exterior perimeter of the cage while keeping both cords in the center of the cage. The user then positions the cowling to its desired location and slides the cords outward to the rim of the cage. The user then pulls a few normal strokes to inflate the cowling and rechecks the position of the cowling and elastic cords. Once the position is suitable for the user, he or she can begin to exercise.

INDUSTRIAL APPLICABILITY

The invention has applicability to the field of air resisted exercise devices. In particular, the present invention describes a device for directing a concentrated flow of air toward a user of such devices.

In compliance with the statute, the invention has been described in language more or less specific as to structural features. It is to be understood, however, that the invention is not limited to the specific features shown or described, since the means and construction shown or described comprise preferred forms of putting the invention into effect. Additionally, while this invention is described in terms of being used on a stationary rowing machine, it will be readily apparent to those skilled in the art that the invention can be constructed from a wide variety of materials and that it can also be adapted to other air resisted exercise machines as well. The invention is, therefore, claimed in any of its forms or modifications within the legitimate and valid scope of the appended claims, appropriately interpreted in accordance with the doctrine of equivalents.

What is claimed is:

1. A device for directing air flow at a user of air resisted exercise devices, said device comprising:

an exercise unit having a plurality of fan-type blades that rotate in a plane that is aligned with the user, said fan-type blades being enclosed in a cage;

a substantially flexible cowling, said cowling having a shape that corresponds to the shape of said cage that encloses said plurality of said fan-type blades;

said cowling further having an arch shaped cross-section along a length of said cowling with legs of the arch forming walls of said cowling, and edges of said cowling being located at the base of said legs; and a means for removably attaching said cowling to said cage.

2. The device of claim 1 wherein said cowling is constructed from a low-porosity fabric.

3. The device of claim 2 wherein said low-porosity fabric is rip-stop nylon having a denier selected from the range of 100 to 250.

4. The device of claim 1 wherein said cage that encloses said plurality of fan-type blades is circular in shape, and said cowling is semicircular in shape.

5. The device of claim 1 further comprising two channel welts wherein said means of attaching said cowling to said cage is a pair of elastic cords;

said channel welts comprising a narrow strip of fabric attached to both sides of said walls of said cowling such that a channel is created;

each of said cords being of sufficient length to fit snugly around an outside perimeter of said cage; and one of said walls of said cords is inserted through each of said channel welts until a portion of said cords protrudes from each end of said channel welts.

6. The device of claim 5 wherein the ends of each of said cords are connected together after said cords are inserted through said channel welts.

7. A device for directing air flow at a user of air resisted exercise devices, said device comprising:

an exercise unit having a plurality of fan-type blades that rotate in a plane that is aligned with the user, said fan-type blades being enclosed in a cage;

a cowling;

said cowling having a shape that corresponds to a shape of a cage that encloses a plurality of fan-type blades on an air resisted exercise device;

said cowling further having an arch shaped cross-section along a length of said cowling with legs of the arch forming walls of said cowling, and edges of said cowling being located at the base of said legs; and a means for removably attaching said cowling to said cage.

8. The device of claim 7 wherein said cowling is constructed from a semi-rigid material.

9. The device of claim 8 wherein said semi-rigid material is plastic.

10. The device of claim 7 wherein said cage that encloses said plurality of fan-type blades is circular in shape, and said cowling is semicircular in shape.

11. The device of claim 7 further comprising two channel welts wherein said means of attaching said cowling to said cage is a pair of elastic cords;

said channel welts comprising a narrow strip of fabric attached to both sides of said walls of said cowling such that a channel is created;

each of said cords being of sufficient length to fit snugly around an outside perimeter of said cage; and one of said walls of said cords is inserted through each of said channel welts until a portion of said cords protrudes from each end of said channel welts.

12. The device of claim 11 wherein the ends of each of said cords are connected together after said cords are inserted through said channel welts.

13. A device for directing air flow at a user of air resisted exercise devices, said device comprising:

an exercise unit having a plurality of fan-type blades that rotate in a plane that is aligned with the user, said fan-type blades being enclosed in a circular cage having an outer perimeter;

a substantially flexible cowling, said cowling constructed from a low-porosity fabric;

said cowling having a semi-circular shape corresponding to the perimeter of the circular cage that encloses the plurality of fan-type blades;

said cowling further having an arch-shaped cross-section along a length of said cowling with legs of the arch forming walls of said cowling, and edges of said cowling being located at the base of said legs;

two channel welts;

said channel welts comprising a narrow strip of fabric attached to said walls of said cowling such that a channel is created;

a pair of elastic cords;

each of said cords being of sufficient length to fit snugly around perimeter of said cage;

one of said cords is inserted through each of said channel welts until a portion of said cords protrudes from each end of said channel welts and the ends of each of said cords are connected together; whereby said cowling is than removably attached to said exercise device by stretching said cords evenly around the center of said outer perimeter of said cage, sliding said cords to the outside edge of said outer perimeter; and adjusting said cowling so that it will direct air at a user when said exercise device is in use.

14. The device of claim 13 wherein said low-porosity fabric is rip-stop nylon having a denier selected from the range of 100 to 250.

* * * * *